US005778678A

United States Patent [19]

Lee

[11] Patent Number: 5,778,678

[45] Date of Patent: Jul. 14, 1998

[54] METHOD AND APPARATUS FOR PRODUCING LIQUID MIXTURES OF OXYGEN AND NITROGEN

[75] Inventor: Ron C. Lee, Bloomsbury, N.J.

[73] Assignee: The BOC Group, Inc., New Providence, N.J.

[21] Appl. No.: 752,131

[22] Filed: Nov. 20, 1996

[51] Int. Cl.[6] ..... F17C 11/00

[52] U.S. Cl. ..... 62/46.1; 62/616; 62/50.2

[58] Field of Search ..... 62/46.1, 50.2, 62/600, 606, 616, 657

[56] References Cited

U.S. PATENT DOCUMENTS 3,397,548 8/1968 Ergenc ..... 62/616

*Primary Examiner*—Henry A. Bennett

*Assistant Examiner*—Pamela A. O'Connor

*Attorney, Agent, or Firm*—David M. Rosenblum; Salvatore P. Pace

[57] ABSTRACT

A method and apparatus of mixing liquid oxygen and liquid nitrogen to form a liquid mixture in which such streams are passed through a parallel flow heat exchanger in order to form a subcooled liquid oxygen stream and a partly vaporized liquid nitrogen stream both having the same temperature. The partly vaporized liquid nitrogen stream is phase separated in a phase separator to form liquid and vaporized nitrogen phases. The liquid phase stream composed of the liquid nitrogen is mixed with the subcooled liquid oxygen stream, preferably in a mixing tee, in order to form the desired mixture.

7 Claims, 1 Drawing Sheet

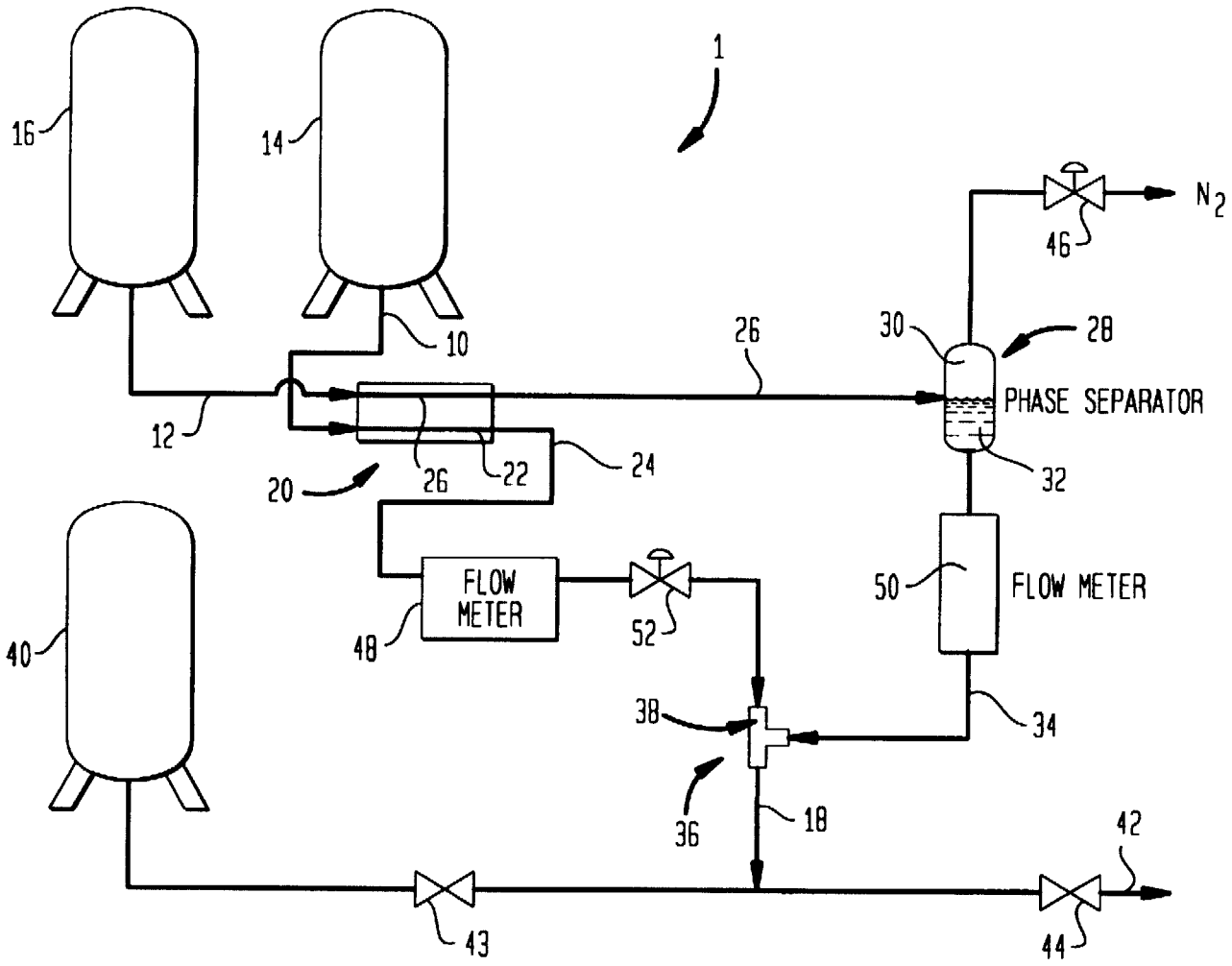
N2
46
28
PHASE SEPARATOR
32
FLOW METER
34
42
44
30
50
18
26
1
36
38
52
24
22
FLOW METER
43
10
26
48
14
20
12
16
40

METHOD AND APPARATUS FOR PRODUCING LIQUID MIXTURES OF OXYGEN AND NITROGEN

BACKGROUND OF THE INVENTION

The present invention relates to a method and apparatus of mixing liquid oxygen and liquid nitrogen in which prior to mixing heat is exchanged to partly vaporize the liquid nitrogen while subcooling the liquid oxygen. More particularly, the present invention relates to such a method and apparatus in which the liquid nitrogen, after having been partly vaporized, is phase separated and the resulting liquid phase is combined with the liquid oxygen in order to form the mixture.

The prior art has provided breathing apparatus, used in underwater and fire fighting applications, that employ a synthetic air mixture as opposed to compressed air. In such apparatus the liquid oxygen and nitrogen are carried in separate tanks and then vaporized and heated prior to inhalation.

Such apparatus, as has been described above, would be less complicated if a liquid, synthetic mixture were provided that could be subsequently vaporized. The problem in forming the mixture is that some of the liquid nitrogen will boil off. The amount of boil off, while being a function of the inlet conditions of the liquid oxygen and liquid nitrogen, produces a ratio of liquid oxygen to liquid nitrogen in the resultant mixture that will typically be different from the mass ratio of liquids that was supplied in forming the mixtures. Practically it is difficult to predict the composition of the resultant mixture because it is difficult to ascertain the inlet conditions. In storage tanks used in supplying liquid oxygen and liquid nitrogen, while it is possible to control pressure, temperature or the degree of subcooling will vary. Thus, the physical states of the liquids just prior to being mixed become an unknown as will the composition of the resultant mixture. Additionally, direct mixing of liquid oxygen and liquid nitrogen at different temperatures will generally provide a foamy mixture that will present further complications in the filling and storing of the liquid mixture.

As will be discussed, the present invention provides a method and apparatus in which liquid respirable mixtures can be formed by directly mixing liquid oxygen and liquid nitrogen in a manner that insures a predicted physical state of the mixture.

SUMMARY OF THE INVENTION

The present invention provides a method of mixing liquid oxygen and liquid nitrogen to form a mixture. In accordance with the method, heat is indirectly exchanged between streams of the liquid oxygen and liquid nitrogen to form a subcooled liquid oxygen stream and a partly vaporized liquid nitrogen stream, both at substantially a same temperature. The pressure of the liquid nitrogen is controlled so that the same temperature is also controlled. The partly vaporized liquid nitrogen stream is phase separated to form liquid/vapor nitrogen phases. A liquid phase stream composed of the liquid nitrogen phase is then combined with a subcooled liquid oxygen stream in order to form the mixture.

In another aspect, the present invention provides an apparatus for mixing liquid oxygen and liquid nitrogen streams to form a mixture. The apparatus comprises a parallel flow heat exchanger having first and second passes for the liquid oxygen and liquid nitrogen, respectively, to undergo indirect heat exchange, thereby to form a subcooled liquid oxygen stream and a partly vaporized liquid nitrogen stream, both at substantially a same temperature. The same temperature is dependent upon a pressure of the liquid nitrogen. A phase separator is connected to the second pass of the parallel heat exchanger for receiving the partly vaporized liquid nitrogen stream and to form liquid and vapor nitrogen phases. A means is connected to the phase separator and in communication with the first pass of the parallel flow heat exchanger for combining a liquid phase stream composed of the liquid nitrogen phase with the subcooled liquid oxygen stream.

The parallel flow heat exchanger, on the one hand, acts to subcool the liquid oxygen and to partly vaporize the nitrogen. The temperature of the partly vaporized nitrogen will be the temperature of saturated nitrogen at a given or controlled pressure, as will the temperature of the liquid oxygen. Since the pressure of the liquid nitrogen supplied to the parallel flow heat exchanger can be accurately controlled and set, control of such supply pressure alone will accurately define the state of the mixture of liquid oxygen and liquid nitrogen. Liquid oxygen pressure will only affect the supply rate of the liquid oxygen and can therefore be controlled for such purpose. As a result, the mixing is essentially independent of variations, other than pressure, in the storage tanks. Since liquid oxygen and liquid nitrogen are never directly combined prior to their being brought into equilibrium, hard to handle foamy mixtures are not produced by the present invention.

BRIEF DESCRIPTION OF THE DRAWING

While the specification concludes with claims distinctly pointing out the subject matter that Applicant regards as his invention, it is believed that the invention will be better understood when taken in connection with the accompanying drawings in which the sole FIGURE is a schematic of an apparatus for carrying out a method in accordance with the present invention.

DETAILED DESCRIPTION

With reference to the FIGURES, an apparatus 1 is illustrated in which liquid oxygen and liquid nitrogen streams 10 and 12 made up of liquid oxygen and liquid nitrogen stored within tanks 14 and 16, respectively, are combined to produce a product mixture stream 18. The pressures within tanks 14 and 16 are controlled in a manner well known in the art. As mentioned above, pressure control within tank 16 is particularly critical for defining the state of product mixture stream 18.

Liquid oxygen stream 10 and liquid nitrogen stream 12 flow through a parallel flow heat exchanger 20 having first and second passes 22 and 26. The resultant heat exchange between liquid oxygen and liquid nitrogen streams 10 and 12 produce a subcooled liquid oxygen stream 24 and a partly vaporized liquid nitrogen stream 26. Subcooled liquid oxygen stream 24 has a temperature substantially equal to partly vaporized liquid nitrogen stream 26. In parallel flow heat exchanger 20, the nitrogen, being colder than the liquid oxygen, partly vaporizes.

Partly vaporized liquid nitrogen stream 26 is introduced into a phase separator 28 to produce a nitrogen vapor phase 30 and a liquid nitrogen phase 32. Subcooled liquid oxygen stream then is combined with the liquid phase stream 34 composed of the liquid phase produced within phase separator 28 in a mixing tee 36. Preferably, mixing tee 36 has a jet or orifice 38 to drop the pressure of subcooled liquid oxygen stream 24 to induce mixing of the liquid oxygen and nitrogen. The output of such stream is the product mixture stream 18. Product mixture stream 18 can be routed to a mixture storage tank 40, or can be delivered through an outlet 42. Cutoff valves 43 and 44 can be provided for such purpose.

As can be appreciated, the pressure within liquid oxygen storage tank 14 should be greater than liquid nitrogen tank 16 because pressure is lost in subcooled liquid oxygen stream 24 as it moves through jet 38. As also can be appreciated, phase separator 28 should not present a significant pressure drop that would impede the flow of partly vaporized liquid nitrogen stream 26. To this end, a proportional valve 46 is provided to control the flow of the vapor nitrogen phase from phase separator 28. In order to accurately meter and control the makeup of product mixture stream 18, flow meters 48 and 50 are provided to meter the flow of subcooled liquid oxygen stream 24 and liquid phase stream 34, respectively. In response to readings of flow meters 48 and 50, a proportional valve 52 is provided to regulate the makeup of product mixture stream 18. Alternatively, the composition of product mixture stream 18 can be analyzed, and the flow rates of either or both liquid oxygen stream 24 and liquid phase stream 34 adjusted to achieve the desired composition.

As may be appreciated by those skilled in the art, there are numerous means for controlling the rate of mixing of liquid oxygen stream 24 and liquid phase stream 34. For example, control valve 52 could be relocated to liquid phase stream 34, or an additional control valve could be added for greater flexibility.

Although not illustrated, a static mixer could be provided downstream of mixing tee 36 to produce greater mixing within product mixture stream 18. Moreover, a takeoff could be provided to measure the makeup of product mixture stream 18. Measurement of the oxygen content would determine the ratio of liquid nitrogen and liquid oxygen within product stream 18.

While the present invention has been described with reference to preferred embodiment, as will occur to those skilled in the art, numerous changes, additions and omissions may be made without departing from the spirit and scope of the present invention.

I claim:

1. A method of mixing liquid oxygen and liquid nitrogen to form a mixture, said method comprising:

indirectly exchanging heat between streams of said liquid oxygen and liquid nitrogen to form a subcooled liquid oxygen stream and a partly vaporized liquid nitrogen stream, both at substantially a same temperature;

the pressure of said liquid nitrogen being controlled so that said same temperature is also controlled;

phase separating said partly vaporized liquid nitrogen stream to form liquid and vapor nitrogen phases; and combining a liquid phase stream composed of said liquid nitrogen phase with said subcooled liquid oxygen stream.

2. The method of claim 1, further comprising controlling the flow rate of said subcooled liquid oxygen stream and nitrogen stream, thereby to control composition of said mixture.

3. The method of claim 2, wherein said liquid phase stream is combined with said subcooled liquid oxygen stream in a mixing tee having a jet to drop pressure of said subcooled liquid oxygen stream.

4. The method of claim 1, wherein said liquid phase stream is combined with said subcooled liquid oxygen stream in a mixing tee having a jet to drop pressure of said subcooled liquid oxygen stream.

5. An apparatus for mixing liquid oxygen and liquid nitrogen streams to form a mixture, said apparatus comprising:

a parallel flow heat exchanger having first and second passes for said liquid oxygen and liquid nitrogen streams, respectively, to indirectly exchange heat between said streams of liquid oxygen and liquid nitrogen, thereby to form a subcooled liquid oxygen stream and a partly vaporized liquid nitrogen stream at substantially a same temperature, the same temperature being dependent upon a pressure of the liquid nitrogen;

a phase separator connected to said second pass of said parallel heat exchanger for receiving said partly vaporized liquid nitrogen stream and to form liquid and vapor nitrogen phases; and means connected to said phase separator and in communication with said first pass of said parallel flow heat exchanger for combining a liquid phase stream composed of said liquid nitrogen phase with said subcooled liquid oxygen stream.

6. The apparatus of claim 5, wherein a proportional valve is interposed between said first pass of said parallel flow heat exchanger and said combining means to control composition of said mixture.

7. The apparatus of claim 5, wherein said combining means includes a mixing tee having a jet to drop pressure of said subcooled liquid oxygen stream.

* * * * *